US006215445B1

(12) United States Patent
Chang

(10) Patent No.: US 6,215,445 B1
(45) Date of Patent: Apr. 10, 2001

(54) ANTENNA HOLDER ASSEMBLY FOR A CELLULAR PHONE

(75) Inventor: Daniel Chang, Pa-Te (TW)

(73) Assignee: Auden Technology Mfg. Co., Ltd., Tao-Yuan Hsien (TW)

( * ) Notice: Subject to any disclaimer, the term of this patent is extended or adjusted under 35 U.S.C. 154(b) by 0 days.

(21) Appl. No.: 09/238,513

(22) Filed: Jan. 27, 1999

(51) Int. Cl.[7] ..... H01Q 1/24
(52) U.S. Cl. ..... 343/702; 343/882
(58) Field of Search ..... 343/702, 878, 343/880, 881, 882, 888, 892; H01Q 1/24, 1/36, 3/02

(56) References Cited

U.S. PATENT DOCUMENTS 5,422,651 * 6/1995 Chang ..... 343/749
5,436,633 * 7/1995 Liu ..... 343/723
5,659,889 * 8/1997 Cockson ..... 455/575
6,005,523 * 12/1999 Rudisill ..... 343/702
6,052,090 * 4/2000 Simmons et al. ..... 343/702

* cited by examiner

*Primary Examiner*—Tho Phan
(74) *Attorney, Agent, or Firm*—Dougherty & Troxell

(57) ABSTRACT

An antenna holder assembly includes a mount fixedly fastened to the shell of an antenna, a holder supported on the mount, the holder having a downward mounting rod inserted into the center through hole of the mount, an end cap fastened to the downward mounting rod to secure the holder to the mount, enabling the holder to be rotated on its own axis, and a spring bushing mounted within the center through hole of the mount around the downward mounting rod of the holder.

2 Claims, 4 Drawing Sheets

ANTENNA HOLDER ASSEMBLY FOR A CELLULAR PHONE

BACKGROUND OF THE INVENTION

The present invention relates to an antenna holder assembly for a cellular phone, and more particularly to a simple structure of antenna holder assembly that enables the installed antenna to be smoothly turned to the desired angular position.

A cellular phone may be equipped with an antenna holder assembly for holding an antenna, enabling the antenna to be turned to the desired angular position. FIG. 1 illustrates an antenna holder assembly for this purpose. This structure of antenna holder assembly comprises a holder 10, a top cap 16, a tubular screw member 17, a shell 18, and an induction coil 19. The holder 10 comprises a vertical receiving chamber 21, and two pivot holes 22 transversely aligned at two opposite sides of the vertical receiving chamber 21. The antenna 13 has a flat bottom end 14 inserted into the vertical receiving chamber 21, and pivotably connected between the pivot holes 22 by a pivot 15. The holder 10 is supported on the induction coil 19, having a shoulder 100 stopped below an inward top flange 160 of the top cap 16. Because the induction coil 19 imparts an upward pressure to the holder 10, a friction force is produced between the shoulder 100 and the top flange 160 when the holder 10 is rotated to adjust the antenna 13 to the desired angle. Therefore, much effort should be applied to the holder 10 when rotating the holder 10 to the desired angle.

SUMMARY OF THE INVENTION

The present invention provides an antenna holder assembly which enables the antenna to be smoothly adjusted to the desired angle. According to one aspect of the invention, the antenna holder assembly comprises a mount fixedly fastened to the shell of an antenna, a holder supported on the mount, the holder having a downward mounting rod inserted into the center through hole of the mount, an end cap fastened to the downward mounting rod to secure the holder to the mount, enabling the holder to be rotated on its own axis, and a spring bushing mounted within the center through hole of the mount around the downward mounting rod of the holder. According to another aspect of the present invention, the size of the downward mounting rod of the holder, the springy bushing and the center through hole of the mount can be designed subject to the size of the antenna to be held.

DETAILED DESCRIPTION OF THE PREFERRED EMBODIMENT

Figure 1:
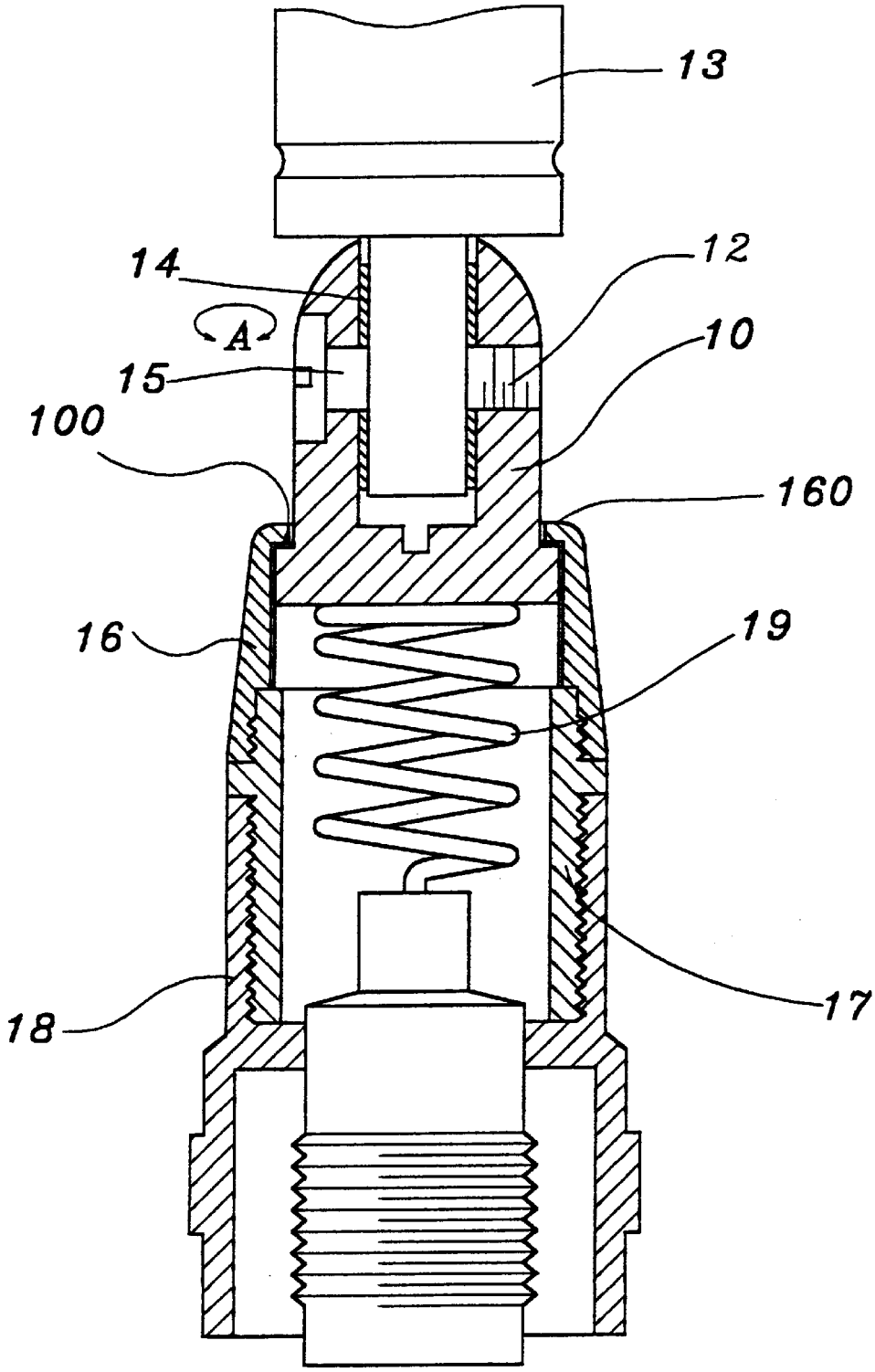
FIG. 1 PRIOR ART
FIG. 1 is a sectional view of an antenna holder assembly according to the prior art.
Figure 2:
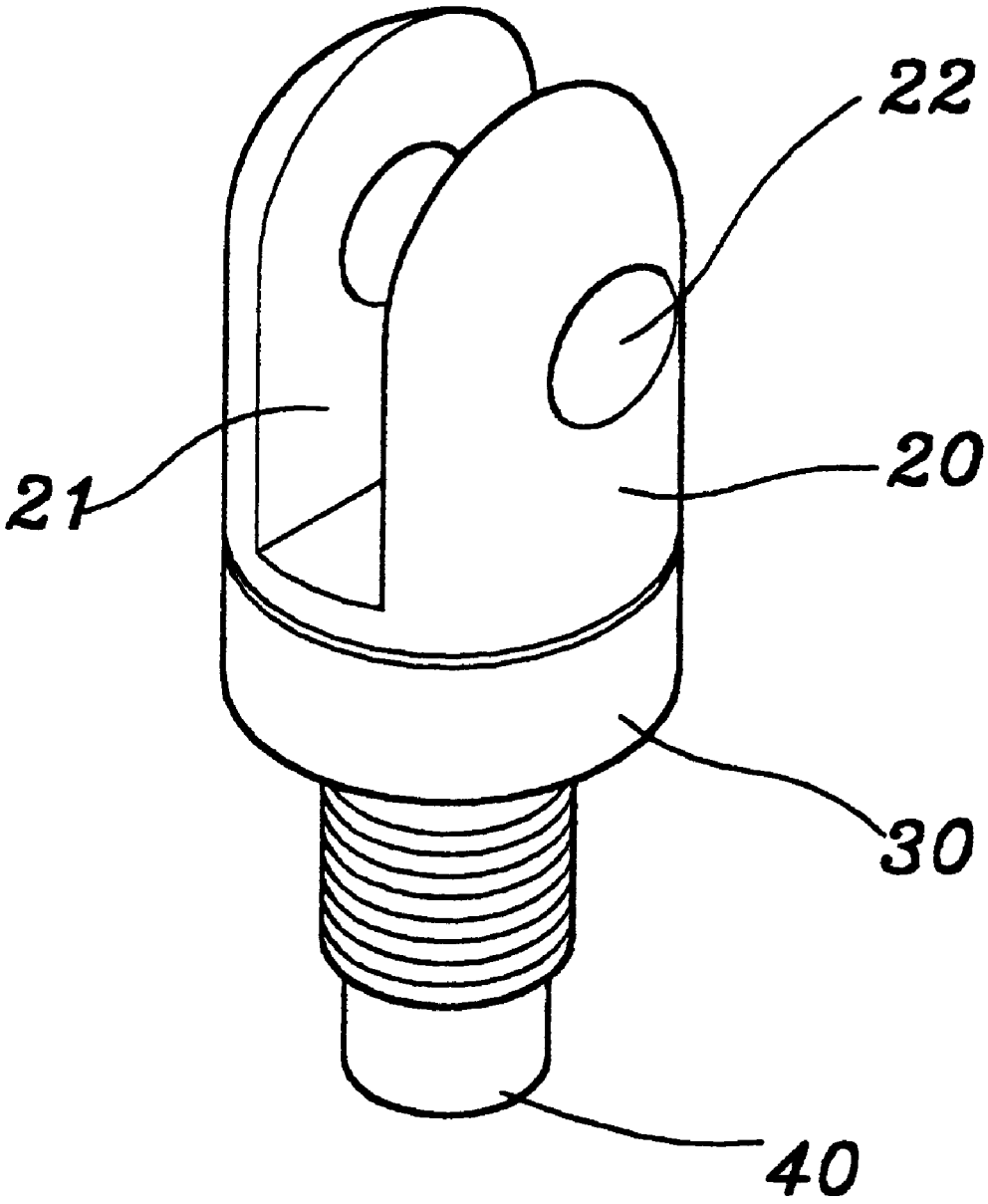
FIG. 2 is an elevational view of an antenna holder assembly according to the present invention.

Referring to FIG. 2, an antenna holder assembly is shown comprised of a holder 20, a mount 30, which carries the holder 20, and a screw cap 40, which secures the holder 20 to the mount 30. The holder 20 comprises a vertical receiving chamber 21, and two pivot holes 22 transversely aligned at two opposite sides of the vertical receiving chamber 21. An antenna can be mounted in the receiving chamber 21, and pivoted to the pivot holes 22.

Figure 3:
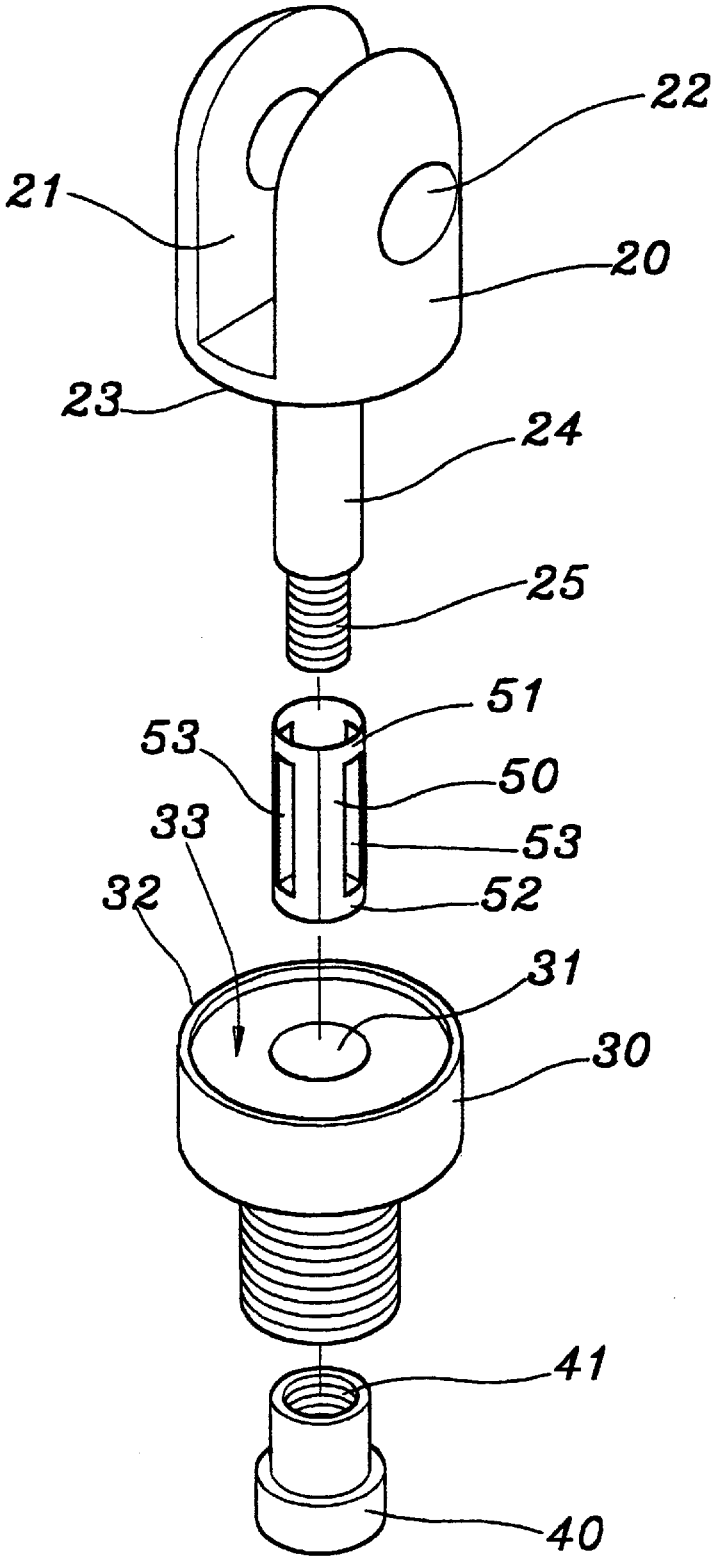
FIG. 3 is an exploded view of the antenna holder assembly shown in FIG. 2.
Figure 4:
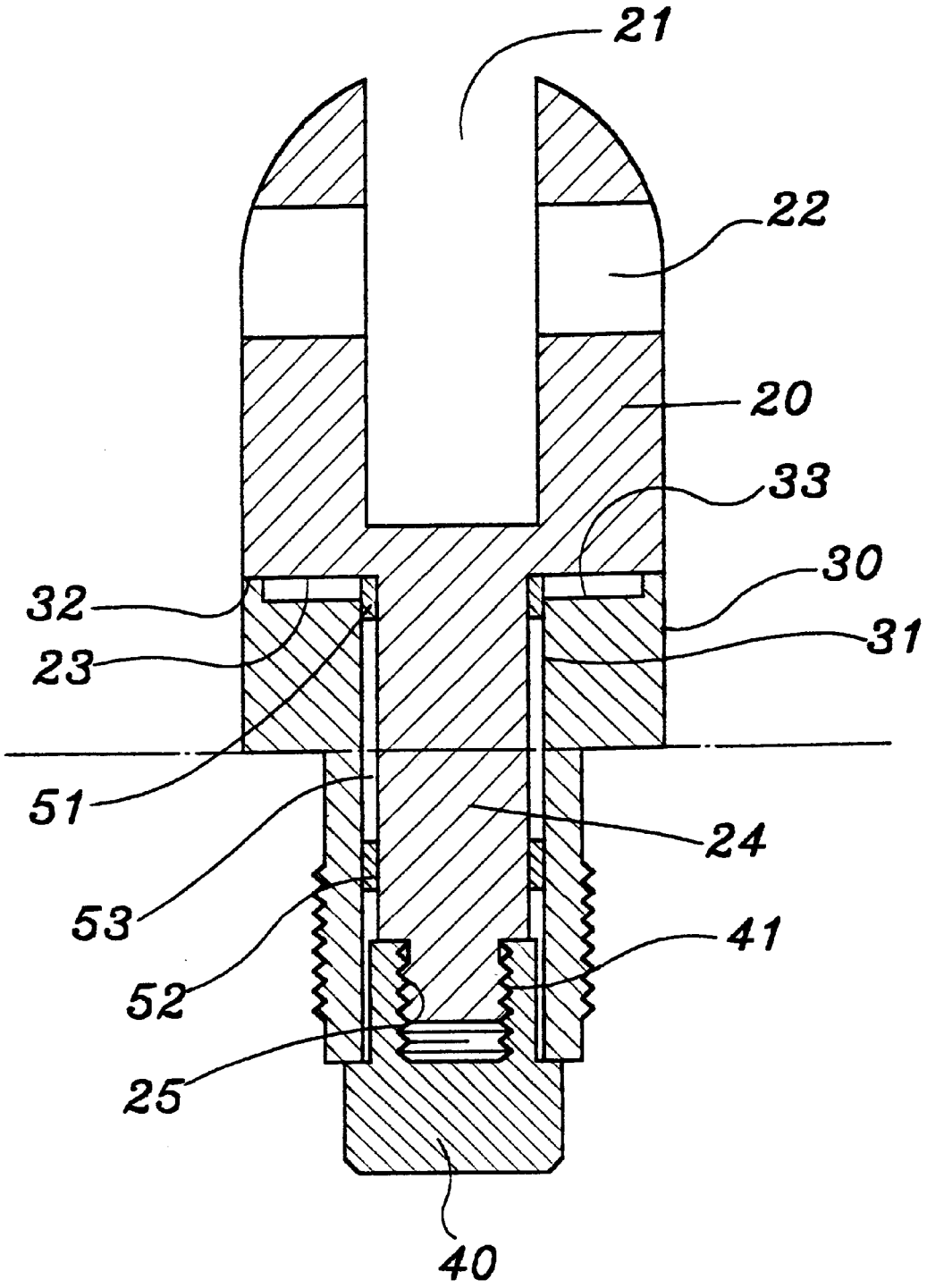
FIG. 4 is a sectional view in an enlarged scale of the antenna holder assembly shown in FIG. 2.

Referring to FIGS. 3 and 4, the holder 20 comprises a downward mounting rod 24 perpendicularly raised from the bottom side wall 23 thereof. The downward mounting rod 24 has its bottom end terminating in a screw rod 25. The mount 30 comprises an upward flange 32 raised from the flat top side wall 33 thereof around the border, a center through hole 31 vertically extended through the center of the flat top side wall 33. The diameter of the center through hole 31 is greater than the diameter of the downward mounting rod 24 of the holder 20. The screw cap 40 is a stepped member having a part inserted into the center through hole 31 from the bottom side, and a part stopped outside the bottom side wall of the mount 30. The screw cap 40 comprises a screw hole 41 threaded onto the screw rod 25 of the downward mounting rod 24 of the holder 20 to secure the holder 20 to the mount 30, enabling the bottom side wall 23 of the holder 20 to be supported on the upward flange 32 of the mount 30. Further, a springy bushing 50 is mounted within the center through hole 31 of the mount 30 around the downward mounting rod 24 of the holder 20. The springy bushing 50 is a cylindrical member made of metal, having a horizontal top ring portion 51, a horizontal bottom ring portion 52, and a plurality of longitudinal slots 53 equiangularly spaced around the periphery between the horizontal top ring portion 51 and the horizontal bottom ring portion 52. The springy bushing 50 supports the downward mounting rod 24 of the holder 20 in the center through hole 31 of the mount 30, enabling the downward mounting rod 24 to be rotated with the holder 20 in the center through hole 31.

When an antenna having a different length and diameter is pivoted to the holder 20, a different pressure is given to the receiving chamber 21 and the pivot holes 22. The antenna holder assembly can be modified to fit the antenna to be matched. For example, the diameter of the downward mounting rod 24 can be relatively increased, or the diameter of the center through hole 31 can be relatively reduced. On the contrary, when a shorter or lighter antenna is used, the length of the downward mounting rod 24 can be relatively shortened, or the diameter of the center through hole 31 can be relatively increased.

While only one embodiment of the present invention has been shown and described, it will be understood that various modifications and changes could be made thereunto without departing from the spirit and scope of the invention disclosed.

What the invention claimed is:

1. An antenna holder assembly comprising a mount fastened to the shell of a cellular phone, said mount having a vertical center through hole vertically extended through top and bottom side walls thereof, a holder supported on said mount to hold an antenna, said holder comprising a downward mounting rod perpendicularly raised from a bottom side wall thereof and inserted into the center through hole on said mount, and an end cap fastened to said downward mounting rod of said holder by a screw joint and stopped outside the bottom side wall of said mount to secure said holder to said mount, enabling said holder to be rotated in said center through hole of said mount, and a springy bushing mounted around said downward mounting rod of said holder inside the center through hole of said mount.

2. The antenna holder assembly of claim 1 wherein said springy bushing is a cylindrical member made of metal, having a horizontal top ring portion, a horizontal bottom ring portion, and a plurality of longitudinal slots equiangularly spaced around the periphery thereof between said horizontal top ring portion and said horizontal bottom ring portion.

* * * * *